United States Patent [19]

Gavin et al.

[11] 4,344,019

[45] Aug. 10, 1982

[54] PENNING DISCHARGE ION SOURCE WITH SELF-CLEANING APERTURE

[75] Inventors: Basil F. Gavin, Berkeley; Robert A. MacGill, Richmond; Raymond K. Thatcher, El Cerrito, all of Calif.

[73] Assignee: The United States of America as represented by the United States Department of Energy, Washington, D.C.

[21] Appl. No.: 205,398

[22] Filed: Nov. 10, 1980

[51] Int. Cl.[3] ..... H01J 27/04

[52] U.S. Cl. ..... 315/111.81; 250/423 R; 313/230

[58] Field of Search ..... 315/111.81, 111.91; 313/230, 231, 359, 363; 250/423 R, 427

[56] References Cited

U.S. PATENT DOCUMENTS

| | | | |
|---|---|---|---|
| 2,883,580 | 4/1959 | Kilpatrick | 315/111.91 |
| 3,566,185 | 2/1971 | Gavin | 315/111.91 |
| 3,955,118 | 5/1976 | Flemming | 315/111.81 |
| 4,135,094 | 1/1979 | Hull | 250/427 |

FOREIGN PATENT DOCUMENTS 829783 3/1960 United Kingdom .

OTHER PUBLICATIONS

Gavin, *A Sputtering Type Penning Discharge for Metallic Ions,* Nuclear Instruments and Methods, 64, (1968), pp. 73–76.

*Primary Examiner*—Eugene R. La Roche
*Attorney, Agent, or Firm*—Clifton E. Clouse; Roger S. Gaither; Richard G. Besha

[57] ABSTRACT

An ion source of the Penning discharge type having a self-cleaning aperture is provided by a second dynode (24) with an exit aperture (12) in a position opposite a first dynode 10*a*, from which the ions are sputtered, two opposing cathodes (14, 16), each with an anode (18, 20) for accelerating electrons emitted from the cathodes into a cylindrical space defined by the first and second dynode. A support gas maintained in this space is ionized by the electrons. While the cathodes are supplied with a negative pulse to emit electrons, the first dynode is supplied with a negative pulse (e.g., −300 V) to attract atoms of the ionized gas (plasma). At the same time, the second dynode may also be supplied with a small voltage that is negative with respect to the plasma (e.g., −5 V) for tuning the position of the plasma miniscus for optimum extraction geometry. When the negative pulse to the first dynode is terminated, the second dynode is driven strongly negative (e.g., −600 V) thereby allowing heavy sputtering to take place for a short period to remove virtually all of the atoms deposited on the second dynode from material sputtered off the first dynode. An extractor (22) immediately outside the exit aperture of the second dynode is maintained at ground potential during this entire period of sputtering while the anode, dynode and cathode reference voltage is driven strongly positive (about +20 kV to +30 kV) so that ions accelerated through the aperture will be at ground potential. In that manner, material from the first dynode deposited on the second dynode will be sputtered, in time, to add to the ion beam. Atoms sputtered from the second dynode which do not become ionized and exit through the slit will be redeposited on the first dynode, and hence recycled for further ion beam generation during subsequent operating cycles.

14 Claims, 8 Drawing Figures

PENNING DISCHARGE ION SOURCE WITH SELF-CLEANING APERTURE

ORIGIN OF THE INVENTION

The invention described herein resulted from Contract W-7405-ENG-48 between the United States Department of Energy and the University of California.

BACKGROUND OF THE INVENTION

The invention relates to an ion source of the Penning discharge type, and more particularly to a Penning discharge ion source with a self-cleaning aperture.

The problems of vaporizing materials at a high temperature in order to produce ions of the material are avoided by using the Penning (oscillating electron) discharge with a cold sputter electrode disposed between cathodes as disclosed in U.S. Pat. No. 3,566,183 by Basil F. Gavin, one of the present inventors, and reported by him in a paper titled "A Sputtering Type Penning Discharge For Metallic Ions," *Nuclear Instruments and Methods* 64 (1968) at pages 73–76.

An offspring of the Penning discharge ion source described in that patent and paper has been successfully used. That offspring is described in detail hereinafter with reference to drawings. Although it solved one problem, it created another problem, namely that the exit slit for the ions tends to become clogged. This occurs for two reasons: some of the atoms move directly from the sputter electrode to the exit slit and deposit there, and ions are neutralized and deposited on the slit. Clogging the slit renders the ion source inoperative until a new slit is provided, and the deposited material which clogs the slit is lost, thus reducing the lifetime of the ion source. Reliable and long lifetime sources are necessary for particle accelerators for atomic and nuclear research, and as sources of heavy ions for biomedical applications and cancer therapy. They are also expected to be used extensively in future fusion energy systems.

OBJECTS AND SUMMARY OF THE INVENTION

An object of this invention is to provide apparatus for preventing the exit aperture of a repeatedly pulsed sputtering type ion source from clogging.

Still another object is to provide apparatus for removing any material deposited on the inside of structure defining an exit aperture in a pulsed sputtering type ion source, and to recycling sputtered material thus removed during each pulse cycle.

Both objects of the invention are achieved in an ion source of a Penning discharge type by providing a second dynode with an exit aperture opposite a first dynode from which ions of a selected material are sputtered. The apparatus, adapted for operation in a magnetic field to produce a Penning discharge, is comprised of two opposing cathodes, each with an anode for accelerating electrons emitted from the cathodes into a cylindrical space defined by the first and second dynodes. These anodes are maintained at a positive potential with respect to not only the cathodes but also both the first and second dynodes. A support gas maintained in this space is ionized by the electrons. While the cathode is supplied with a negative pulse to emit electrons, the first dynode is supplied with a negative pulse (e.g., −300 V) to attract ions of the gas (plasma). At the same time, the second dynode may also be supplied with a small voltage that is negative with respect to the plasma (e.g., −5 V) for tuning the position of the plasma miniscus for optimum extraction geometry. When the negative pulse to the first dynode is terminated, the second dynode is driven strongly negative (e.g., −600 V) thereby allowing heavy sputtering to take place for a short period to remove virtually all of the atoms deposited on the second dynode from material sputtered off the first dynode. An extractor immediately outside the exit aperture is maintained at a very high potential during this entire period of sputtering atoms off the first dynode and then off the second dynode so that ions which exit the aperture will be accelerated. In that manner, material from the first dynode deposited on the second dynode will be sputtered in time to add to the ion beam. Atoms sputtered from the second dynode which do not become ionized and exit through the aperture will be redeposited on the first dynode, and hence recycled for further ion beam generation during subsequent operating cycles.

The novel features that are considered characteristic of this invention are set forth with particularity in the appended claims. The invention will best be understood from the following description when read with reference to the accompanying drawings.

Reference will now be made in detail to the prior art and to a preferred embodiment of the invention, an example of which is illustrated in the accompanying drawings.

DESCRIPTION OF PREFERRED EMBODIMENTS

Figure 1:
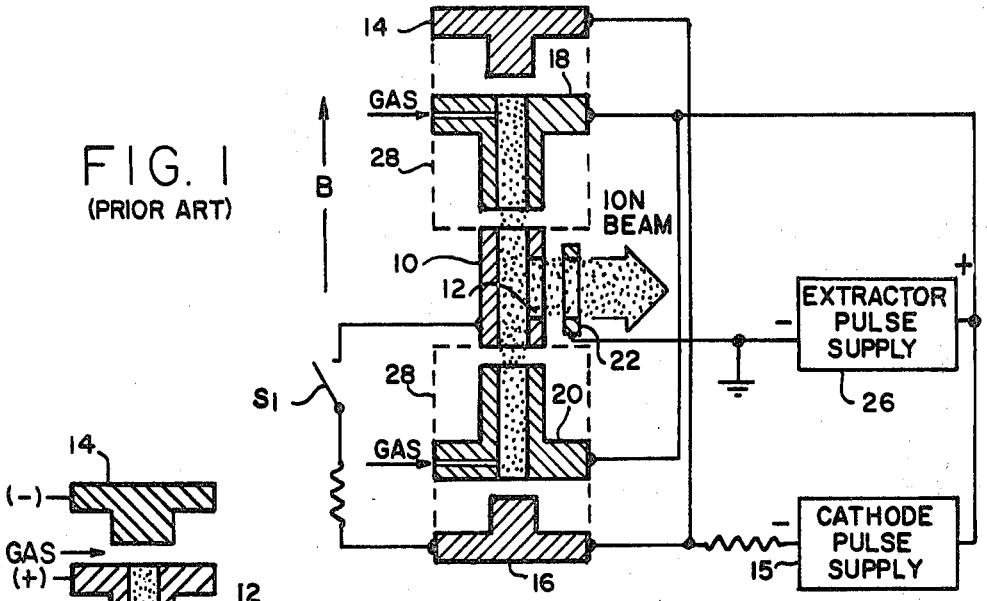
FIG. 1 (PRIOR ART)
FIG. 1 is a schematic diagram of the prior patented Penning ion discharge source.

Referring first to the prior-art Penning discharge ion source shown in FIG. 1, a tubular cold sputter electrode 10 of material such as gold, is provided with a slit 12 on one side. This electrode 10, referred to hereinafter as a dynode, is positioned between two cold titanium cathodes 14, 16. Electrons from the cathodes are accelerated into the dynode by annular anodes 18, 20 positioned near the cathodes. A magnetic field, B, of typically 4000 to 6000 Gauss is produced by concentric coils (not shown) around the anodes and dynode to minimize the spread of the electrons passing through the anodes into the cylindrical space in the dynode. An inert gas, such as nitrogen or argon, is pumped through the anodes into this space at a pressure sufficient to maintain a minimum gas flow necessary for arcing, as may be determined empirically for a particular gas and operating conditions.

The accelerated electrons ionize the gas, and the gas ions in turn bombard the dynode 10 to sputter close to their own number of atoms from the dynode material. Trapped electrons ionize most of the atoms thus produced, and the positive ions are extracted through the dynode slit 12 by an electrode 22, called an extractor, which is connected to ground so that the ion beam will be at ground potential. Inasmuch as the exit slit is part of the dynode and subject therefore to considerable wear, the exit slit did increase in size and lead to overloading of the extraction system. No control could be exercised as to the state of the exit slit.

Figure 2:
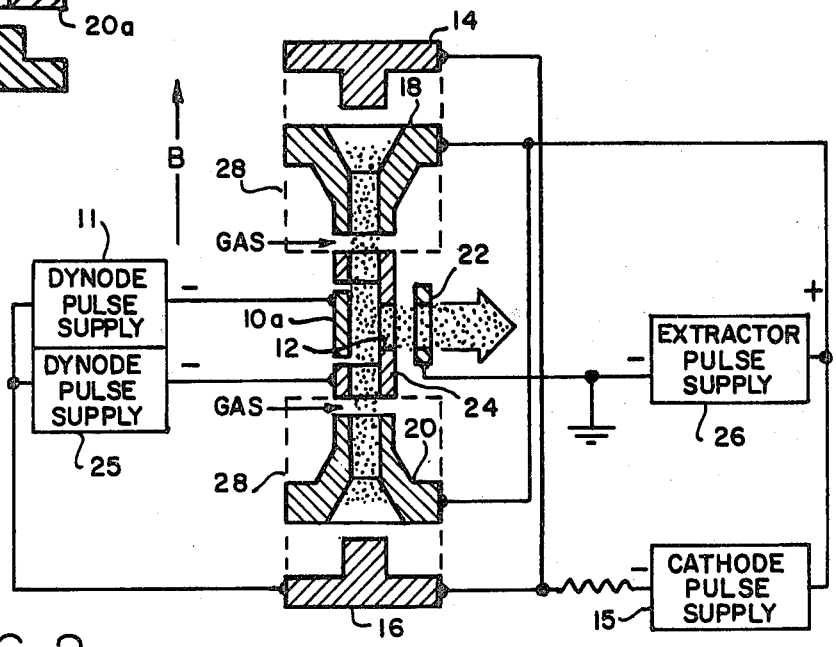
FIG. 2 is a schematic diagram of the present invention.

Subsequent alterations had the dynode reduced in size and, as it were, fitted into the anode, very much like the first dynode is fitted into the second dynode of the present invention shown in FIG. 2. However, it should be realized that the concept of the second dynode had still not been conceived, and that the electrode surrounding the dynode was in fact the anode without any provision for the creation of another electrode.

Figure 1A:
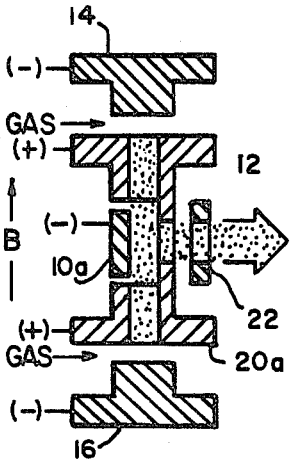
FIG. 1a (PRIOR ART)
FIG. 1*a* illustrates a modification of that prior ion source.

FIG. 1*a* schematically illustrates this modified dynode and anode arrangement. The smaller dynode is represented by the reference numeral 10*a*, and the one piece anode is 20*a*. The cathodes and extractor remain the same as before. Note that the exit slit 12 is now in the one piece anode directly opposite the dynode (sputtering electrode) 10*a*, and therefore subject to having substantial material deposited on it from the sputtering electrode. This deposition of material tends to clog the exit slit. All that was achieved by this offspring of the prior patented ion source shown in FIG. 1 was a solution to the problem of the exit slit widening due to sputtering of material around the exit slit. Since the exit slit of the offspring was at anode potential, the slit would not widen, but instead would eventually clog so it could no longer be used reliably.

The present invention mitigates this clogging of the exit slit by effectively dividing the sputter electrode in half along its axis and thus providing the slitted second half as a second dynode 24, as shown in FIG. 2, wherein the same reference numerals are provided for the corresponding electrodes of the prior-art apparatus shown in FIG. 1.

Having the slitted half of the sputter electrode separate allows for providing the exit slit with a voltage that is equal to, or preferably slightly negative with respect to the anode (i.e., close to the plasma potential) while the first dynode (main sputter electrode) is pulsed with a large negative voltage. Immediately following the pulse supplied to the first dynode, i.e., immediately after the main ion beam exits, the pulse supplied to the second dynode is driven strongly negative, allowing heavy sputtering of deposited material on the second dynode, which is ionized to continue to provide an ion beam, although of a slightly lower efficiency (60% to 70%). Material sputtered from the second dynode which does not exit the slit as ions are redeposited on the first dynode.

The operation of the present invention then is similar to that of the prior-art ion sources shown in FIG. 1 and the offspring shown in FIG. 1*a*, except for the pulse supplied to the second dynode, and the electrical separation between the second dynode and anode. Consequently, the operation of the prior-art ion source of FIG. 1 will first be reviewed before presenting a more detailed description of the operation of the present invention.

Referring to FIG. 1, a negative pulse is supplied to the cathodes 14, 16 from a source 15 while a positive voltage pulse is applied to the anodes 18, 20 from a separate source 26. An inert gas is introduced into the dynode through the anodes 18, 20 which are enclosed in chambers formed of ceramic material represented by dashed lines 28.

The periphery of the plasma column formed by ionizing the gas takes on a potential close to the most positive potential of the system, which is the potential of the anodes 18, 20. At the same time the voltage of the floating dynode can be considered to be close to but negative with respect to the anode potential. The result is an arc (effective electron current) between the gas and the dynode. A switch $S_1$ between the cathodes and the dynode 10 (or a power supply between the anodes and dynode) may be activated to place a negative voltage on the dynode, thereby to reduce the minimum gas flow required to strike the arc. This negative voltage is typically −300 V.

The ions which exit the slit form an ion beam. So that they will exit at ground potential and with high velocity, the extractor 26 is connected to ground and is effectively supplied with a strongly negative voltage, typically −20 kV to −30 kV, from shortly before the cathode and dynode are driven negative until after the dynode pulse has been terminated. This is accomplished by connecting the negative terminal of the extractor pulse supply 26 and the extractor to ground, and operating the pulse supply 26 at +20 kV to +30 kV, thus effectively shifting the system reference to the high positive potential of the extractor pulse supply during the ion beam pulse period. The anodes 18 and 20 are strongly positive and the cathode pulse supply 15 drives the cathodes 14 and 16 negative with respect to this strongly positive (+20 kV to +30 kV) load. The cathode and extractor pulses are terminated at the same time to complete a cycle. In practice, the cycle may be repeated many times per second, until sputtering of the dynode 10 widens the slit.

Operation of the prior-art ion source with the modification shown in FIG. 1*a* is the same. It differs only in the construction which makes the exit slit 12 part of the anode. As the ion beam exits, atoms that leave the sputter electrode gradually deposit on the inside of the anode 20*a* around the slit. This occurs because some atoms move directly from the dynode 10*a* to the surface around the exit slit and deposit there without being ionized, and ionized atoms become neutralized and deposited on the inside of the dynode. The dynode gradually becomes clogged over many hours of operation, typically 15 hours.

By providing part of the prior-art anode 20*a* having the exit slit 12 as a separate, second dynode 24, it is possible to apply to it for a short time a large negative voltage after an ion beam is formed by a negative voltage applied to the other half, referred to herein as the first dynode 10*a*. The second dynode 24 then functions as a sputter electrode in order for any material deposited on it from the first dynode to be sputtered off. Sputtered material from the second dynode 24 then either exits through the slit as a continuation of the ion beam or is redeposited on the first dynode 10*a*. Recycling material in this manner extends the life of the first dynode, and cleans the second dynode so that its slit will not become clogged. Operation of the ion source with a second dynode used in this way has resulted in an increased lifetime from about 15 hours to 25 or 30 hours.

Figure 3:
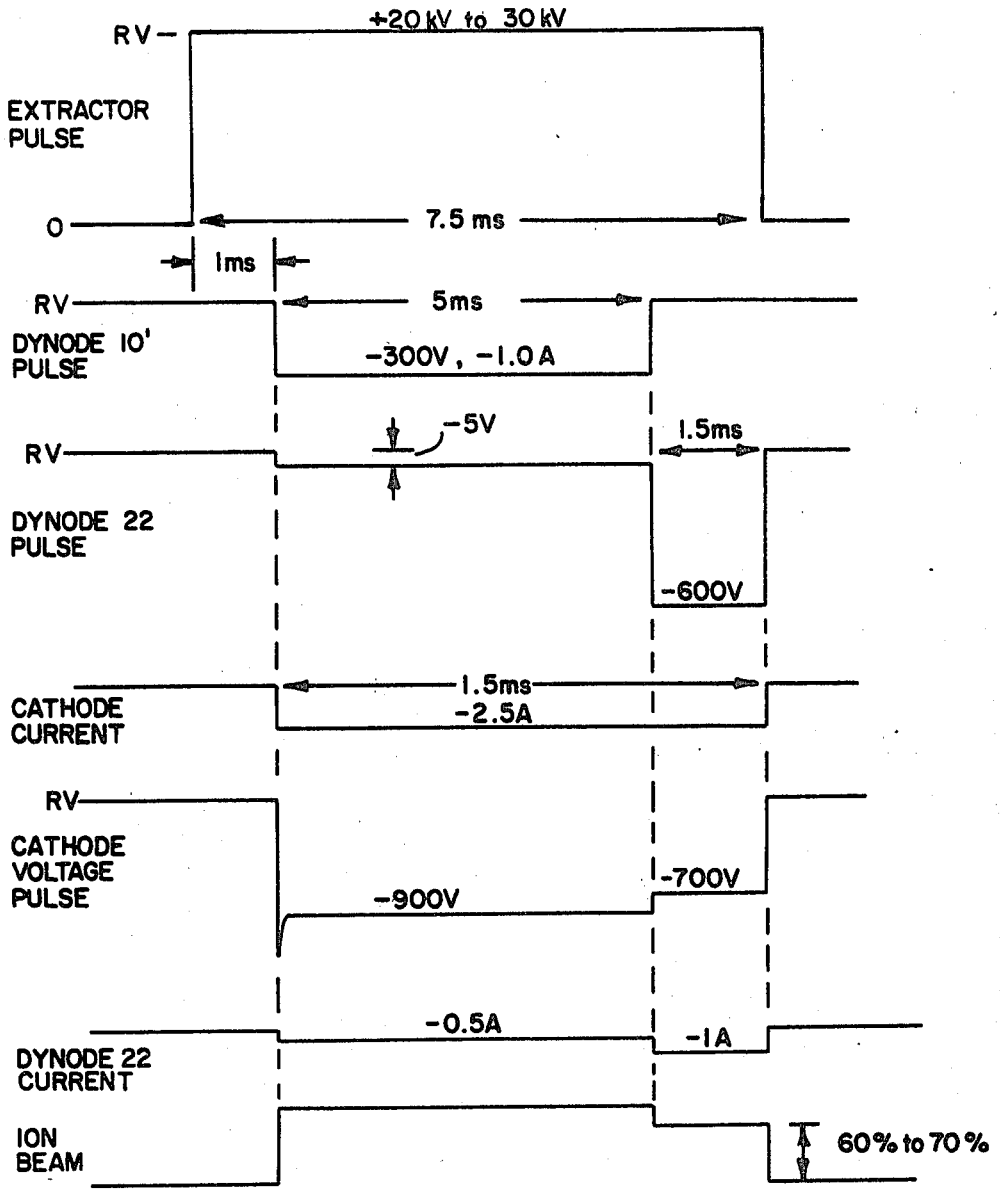
FIG. 3 is a timing diagram for the operation of the present invention.

The operation of such a two-dynode Penning discharge ion source is shown by the timing diagram of FIG. 3.

Referring now to FIG. 3, one operating cycle for the system illustrated in FIG. 2 starts by first supplying an extractor pulse from the source 23. This pulse, which is typically −20 kV to −30 kV for a period of 7.5 ms, could be a negative pulse applied to the extractor 22 if the positive terminal of the source were instead grounded (and a separate positive pulse were supplied to the anode). But that would make the ion beam exit at a very high negative potential. The arrangement shown in FIG. 3 holds the extractor 22 at ground for an ion beam at ground potential, and instead uses the extractor pulse supply to drive the anodes 18 and 20 positive, and also shift the reference voltage (RV) applied to the cathode. This reference voltage is also applied to the dynode 10*a* and 24 through the anode 20 and their respective dynode pulse supply sources 11 and 25.

A negative pulse from the source 15 is applied to the cathodes 1 ms after the extractor pulse. The cathodes are held negative (about −300 V) with respect to the reference voltage of the extractor pulse for 6.5 ms. Simultaneously, a negative pulse from a source 11 is applied to the first dynode 10*a* for 5 ms. The cathode supply pulse, which provides a cathode current of about 2.5 A, is momentarily more negative than −900 V with respect to the reference voltage when first applied simultaneously with the pulse applied to the dynode, but quickly stabilizes at −900 V. The dynode 10*a* is driven to only −300 V so it is +600 V with respect to the cathode and will conduct a current of 1.0 A. An ion beam is thus produced for the time the cathode and first dynode are both receiving supply pulses. Then the second dynode 24 receives a large negative pulse from a source 25, typically −600 V with respect to the reference voltage, RV, for an adjustable time, typically 1.5 ms. The second dynode will now sputter material deposited there while the first dynode was sputtering. This will continue the ion beam at a lower efficiency (60% to 70%) for as long as both the cathode and second dynode are being driven negative. The cathode current is operated as a constant current source, so with a lower ion beam level the cathode voltage becomes less negative, typically −700 V with respect to the reference voltage, RV. Then, at the end of the extractor pulse, cathode and second dynode supply pulses are terminated to end the operating cycle. This cycle may be repeated many times each second, such as 36 times per second.

It should be noted that when the cathode and first dynode operating pulses are initiated, the source 25 drives the second dynode 22 slightly negative (about −5 V with respect to the reference voltage, RV, for a current of about 0.5 A). This small negative voltage allows for tuning of the plasma miniscus position to optimize ion source output extraction geometry. Then, for an adjustable time, the second dynode is driven more negative by the source 25, allowing heavy sputtering of material from it to take place with a current flow of about 1.0 A in the second dynode. This adjustable time is set empirically to sputter only material deposited on it from the first dynode. This cleans the exit slit in the second dynode and recycles material to the first dynode, both of which extend the operating life of the ion source. In practice the time is adjusted to leave just a very thin film of deposited material on the face of the second dynode so as not to sputter any of the material of that dynode, which may be any conductive material, such as copper, while the first dynode is of the material selected for the ion beam, such as gold.

Figure 4:
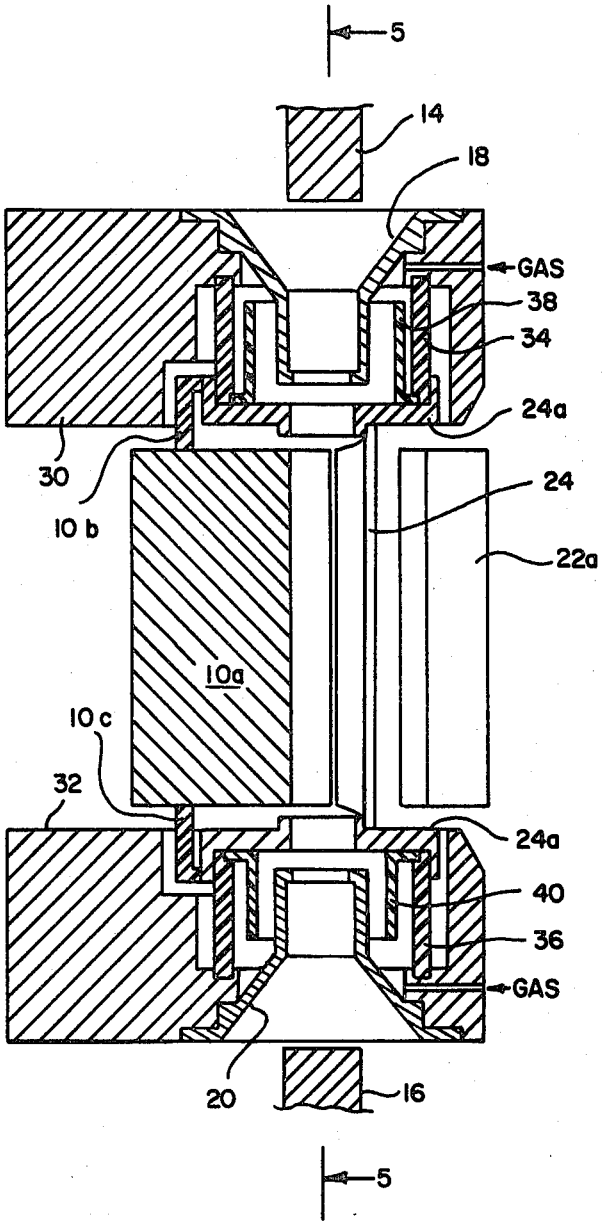
FIG. 4 is a cross section of an exemplary embodiment of the invention.
Figure 6:
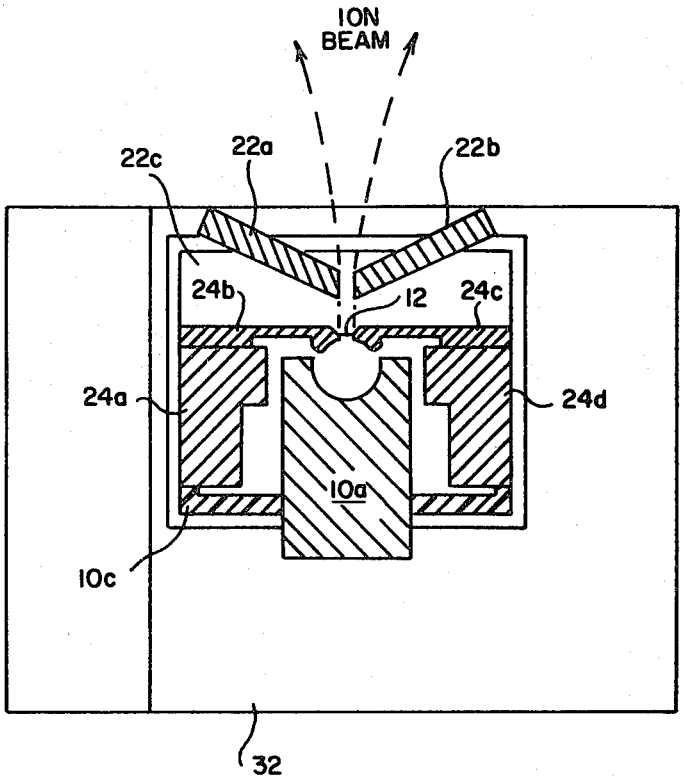
FIG. 6 is a cross section taken on a line 6—6 in FIG. 5.
Figure 7:
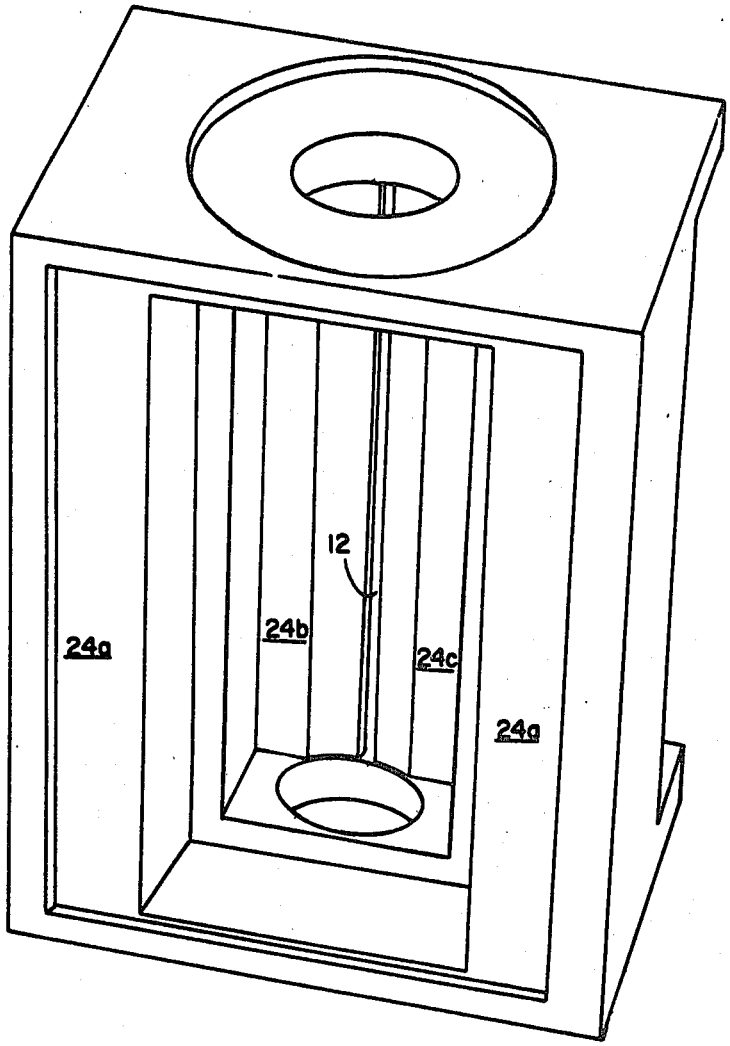
FIG. 7 is a perspective view of the second dynode showing the slit thereof from the inside with the first dynode removed.

An exemplary construction of the ion source electrodes shown schematically in FIG. 2 will now be described with reference to FIGS. 4, 5 and 6. FIG. 4 is a sectional view corresponding to that shown schematically in FIG. 2. For convenience, the same reference numerals as those used for the corresponding parts will be used in FIGS. 4, 5 and 6 as in FIG. 2. The first dynode 10*a* is a block with the sputtering face formed in the shape of a half cylinder as better shown in FIG. 6. The second dynode 24 is comprised of a solid body 24*a* of the form shown in a perspective view in FIG. 7 with an opening on the near side as viewed in the figure to receive the first dynode, and an opening on the far side to receive members 24*b* and 24*c* which define the slit 12 as best shown in FIG. 6, and to also receive tantalum members 22*a* and 22*b* which form an extractor slit directly opposite the exit slit 12. These members are electrically isolated from the body 24*a*, and from the exit slit members 24*b* and 24*c* by external support members (not shown). The first dynode 10*a* is isolated by ceramic members 10*b* and 10*c*.

This entire assembly of the first and second dynodes 10*a* and 24 with an exit slit 12 and an extractor 22 is secured between two mounting blocks 30, 32 having apertures machined to receive cone shaped anodes 18′ and 20′, and to receive annular quartz spacers 34, 36 between the mounting blocks 30, 32 and the body 24*a* of the second dynode. Concentric with the spacers and closure to the anodes are quartz shields 38, 40. It is thus apparent that only the elements 24*b* and 24*c* of the second dynode are electrically connected to the main body 24*a*. The hot tungsten cathodes 14, 16 are positioned near the anodes by support means not shown for the mounting blocks.

Figure 5:
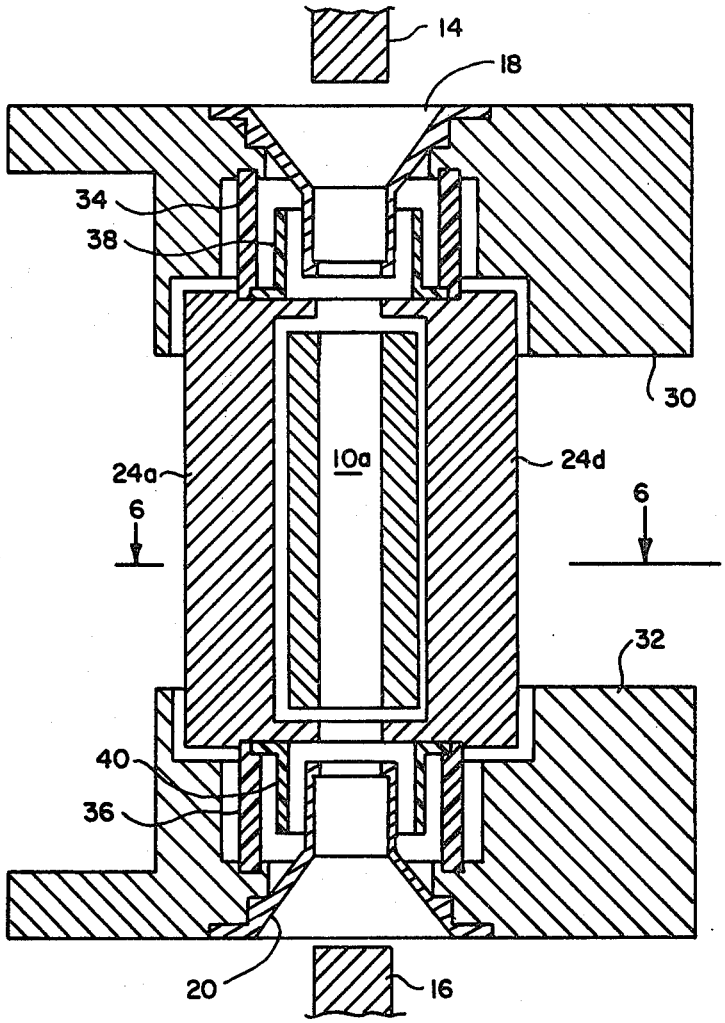
FIG. 5 is a cross section taken on a line 5—5 in FIG. 4.

Although the inert gas could be introduced into the space between the first and second dynodes through the anodes, as in the prior-art system schematically shown in FIG. 1, it is found to be more convenient to introduce the gas through the mounting blocks 30 and 32 as shown in FIG. 5. Sufficient pressure is maintained on the gas line to provide the minimum gas flow to support electron current from the cathode via the plasma and first dynode. The arc for this current will not strike without sufficient gas, but the minimum gas flow restriction is lowered by operating the first dynode at −300 V during the main beam forming period. Thereafter a corresponding electron current is supported between the cathode and the second dynode which is operated at an even more negative voltage (−600 V).

It should now be apparent that a Penning discharge ion source is provided with a self-cleaning exit slit by separating the dynode into two parts, a first part serving as a first dynode sputtering out toward the slit in a second part during a first major period of a pulsed ion beam cycle, and the second part serving as the second dynode sputtering out toward the first part during a second minor period of the pulsed ion beam. This not only cleans the exit slit, but recycles sputtered material deposited on the second dynode back to the first dynode, thereby extending the life of the first dynode. The result is reliable use of the ion source for a longer time. Experience has shown that this time of extended use is approximately doubled that of the prior-art ion source.

Although a particular embodiment of the invention has been described and illustrated herein, it is recognized that modifications and variations may readily occur to those skilled in the art, particularly in the proportions of elements and in the selection of materials. For example, although a long and narrow slit is shown, in practice the ion beam may be allowed to exit through an aperture that is so wide, as compared to its length, as to not normally be regarded as a slit. Consequently, it is intended that the claims be interpreted to cover such modifications and variations.

What is claimed is:

1. In a Penning discharge ion source, an improvement comprised of a dynode separated into two parts, a first part serving to provide material to be sputtered to form an ion beam, and a second part having an exit aperture for said ion beam, means for supplying a pulse to said first part to sputter material therefrom into said ion beam for a predetermined interval, and means for supplying a pulse to said second part following said interval and continuing said pulse to said second part for an interval just sufficient to clean any material deposited from said first part, thereby continuing said ion beam while cleaning said aperture, and recycling material to said first part which does not exit through said aperture in said second part.

2. In apparatus of the Penning discharge type, including a normally solid material, for producing a beam of ions from said normally solid material, where said material is electrically connected and physically positioned to function as a dynode means for sputtering ions of said material, said dynode means enclosing a space in which a support gas is maintained and into which electrons from cathode means are accelerated for ionizing said gas, thereby to bombard said material and sputter ions of said material, and where said dynode means has an aperture for the exit of said ions of said material, an improvement comprised of said material being electrically separated into two parts, thereby to provide first and second dynodes, one opposite the other with said space in between, said material being an integral part of said first dynode and said aperture being in said second dynode, means for supplying an operating pulse to said cathode means for a predetermined period, means for supplying an operating pulse to said first dynode for a major first part of said cathode pulse period, and means for supplying an operating pulse to said second dynode for a minor second part of said cathode pulse period, thereby to sputter material deposited on said second dynode into said ion beam during said minor second part of said cathode pulse period and recycle to said first dynode material thus sputtered from said second dynode which does not exit through said aperture as part of said ion beam.

3. In apparatus adapted for producing an ion beam from a source of selected material that is normally in a solid state, said apparatus being adapted for operation in a magnetic field to produce a Penning discharge, the combination comprised of first and second dynodes disposed opposite each other to define a space in between, said first dynode having said material and said second dynode having an aperture for said beam to exit from said space, means for maintaining a support gas in said space, two opposing cathodes one at each end of said space for producing high power pulsed electron beams directed into said space, two accelerating anodes, one adjacent each cathode for accelerating said electron beams into said space, means for supplying an operating pulse to said cathodes for a predetermined period, means for supplying an operating pulse to said first dynode for a first major part of said predetermined period, means for supplying an operating pulse to said second dynode for a second minor part of said predetermined period, whereby said second dynode functions as a sputtering electrode during said second minor part of said predetermined period for removal of material sputtered from said first dynode and deposited on said second dynode during said second minor part of said predetermined period.

4. The combination of claim 3 wherein said means for supplying an operating pulse to said second dynode supplies a small voltage that is negative with respect to said accelerating anodes during said first major part of said predetermined period and close to the potential of plasma formed by electrons ionizing said support gas, said small voltage being selected for tuning the position of a miniscus of said plasma in said space.

5. The combination of claim 3 or 4 wherein said first dynode is comprised of a block of said material having a semicylindrical concave face for defining half of said space, and said second dynode is comprised of two conductive members spaced from each other to form an exit slit therebetween directly opposite said semicylindrical concave face, and the edges of said two members next to said slit are formed on the inside with a curvature conforming to the semicylindrical concave face of said first dynode for defining the other half of said space, and means for electrically isolating said two members of said second dynode from said first dynode, thereby to provide a cylindrical space between said cathodes.

6. The combination of claim 5 including two extractor members spaced from each other to form a slit therebetween directly opposite said exit slit, said two extractor members being electrically isolated, and means for supplying a high voltage to said extractor members to accelerate ions passing through said exit slit.

7. The combination of claim 6 wherein said anodes are cone shaped to funnel electrons from said cathodes into said space.

8. An ion source of a type adopted for operation in a magnetic field to produce a Penning discharge comprising a first dynode from which ions of a selected material are sputtered, a second dynode opposite said first dynode, said second dynode having a slit through which said ions may exit, an extractor positioned next to said slit on the side of said second dynode opposite said first dynode, a gas maintained in a space between said first and second dynodes, means for producing and accelerating electrons into said space for ionizing said gas, thereby to produce a plasma in said space, means for supplying said first dynode with a negative pulse to attract ions of said gas, thereby to sputter ions of said first dynode material, and means for supplying said second dynode with a negative pulse following the pulse applied to said first dynode, thereby to sputter ions of material sputtered from said first dynode and deposited on said second dynode, whereby deposited material is removed from said second dynode to keep said first dynode clean and recycle so much of said material as does not exit said slit to said first dynode.

9. An ion source as defined in claim 8 wherein said negative pulse applied to said second dynode follows immediately after the negative pulse applied to said first dynode and is substantially greater in amplitude, but shorter in time, than said negative pulse applied to said first dynode, whereby ions exiting said slit form a continuous beam during the interval of both said pulses with only a small decrease in ion beam magnitude during the pulse applied to said second dynode.

10. An ion source as defined in claim 9 wherein said extractor is maintained at ground potential and a very high voltage that is negative with respect to other components is effectively applied to said extractor by means for driving the reference voltage of all other components to a very high positive voltage, including said means for supplying said negative pulses applied to said first and second dynodes, whereby said ion beam is extracted at ground potential.

11. An ion source as defined in claim 10 wherein said means for driving said reference to a very high positive voltage is operative from a time shortly before a negative pulse is supplied to said first dynode until a time when the negative pulse supplied to said second dynode is terminated.

12. An ion source as defined in claim 11 wherein said means for producing and accelerating electrons into said space is energized to operate only during the time said negative pulses are applied to said first and second dynodes.

13. An ion source as defined in claims 10, 11 or 12 wherein said electron producing and accelerating means is comprised of a cathode at each end of said space, and an anode between each cathode and said first and second dynodes, and means for driving each cathode negative with respect to each anode.

14. An ion source as defined in claim 13 wherein said means for supplying a negative pulse to said second dynode further produces a small negative voltage at the same time said first dynode is supplied a negative voltage, thereby to tune the position of plasma miniscus for optimum extraction of sputtered ions.

* * * * *